US005732903A

United States Patent [19]

Madrzak

[11] Patent Number: 5,732,903

[45] Date of Patent: Mar. 31, 1998

[54] DEVICE TO FACILITATE THE EXCHANGE OF A MATERIAL LAYER ROLL IN THE SUPPLY COMPARTMENT ON THE FLY WHILE MAINTAINING CONSTANT TENSION IN THE MATERIAL LAYER

[75] Inventor: Zygmunt Madrzak, Heidenheim, Germany

[73] Assignee: Voith Sulzer Papiermaschinen GmbH, Heidenheim, Germany

[21] Appl. No.: 815,970

[22] Filed: Mar. 13, 1997

[30] Foreign Application Priority Data

Mar. 15, 1996 [DE] Germany ..... 296 04 882.8

[51] Int. Cl.[6] ..... B65H 19/16

[52] U.S. Cl. ..... 242/554.5

[58] Field of Search ..... 242/554.5, 554.6, 242/555; 156/504

[56] References Cited

U.S. PATENT DOCUMENTS 4,564,150 1/1986 Keene et al. ..... 242/554.6

5,282,583 2/1994 Hogberg ..... 242/554.5

*Primary Examiner*—John P. Darling

*Attorney, Agent, or Firm*—Taylor & Associates, P.C.

[57] ABSTRACT

An apparatus for unwinding and/or supplying material layers includes a rotatable driving mechanism coupled with a primary reel operable as a drive and a brake. A control unit is connected with the driving mechanism, and includes a rotational speed regulator and a tension regulator. The rotational speed regulator controls a rotational speed of the driving mechanism. The tension regulator maintains a tension in a primary material layer of a primary reel and a secondary material layer of a secondary reel. The rotational speed regulator controls the driving mechanism as a drive such that the primary reel has a rotational speed $n_B$ resulting in a tangential speed of the primary reel which is faster than the process speed of the unwinding secondary material layer. The rotational speed regulator also controls the driving mechanism as a brake such that the rotational speed is decreased from a rotational speed $n_B$ down to a synchronized rotational speed $n_{synch}$, resulting in a tangential speed of the primary reel which is approximately the same as the process speed of the unwinding secondary material layer. The rotational speed regulator further controls the driving mechanism such that at approximately the instant in time when the primary material layer is glued to the secondary material layer, a brake force in the driving mechanism corresponds to a tension force required in the primary and secondary material layers to maintain a stretch within the material layers.

4 Claims, 3 Drawing Sheets

DEVICE TO FACILITATE THE EXCHANGE OF A MATERIAL LAYER ROLL IN THE SUPPLY COMPARTMENT ON THE FLY WHILE MAINTAINING CONSTANT TENSION IN THE MATERIAL LAYER

BACKGROUND OF THE INVENTION

1. Field of the Invention

The present invention relates to a device that is designed to facilitate an exchange on the fly of a roll of a material layer in a supply compartment.

2. Description of the Related Art

A device as described above makes it possible to glue the beginning of a new roll of material (primary reel) to the end of a foregoing roll (secondary reel) from which material is unwinding to be processed later on. Such a device would find primary application in the unwinding compartment of an apparatus for applying a coating onto paper, or in machinery of similar kind in which layers of paper are being treated of processed. It is important that the before mentioned operation of gluing the two layers of material together is done with utmost precision since it has to be performed at full process speed. At full process speed the paper moves at about 1,500 m/min or more. The operation of gluing together two layers on the fly is commonly known in the paper industry as a "flying splice".

According to the state of the art, the exchange on the fly of the roll of material layer is initiated by using a driving mechanism to start rotating the primary reel and then adjusting the tangential velocity of its circumference to the speed at which the other layer unwinds from the secondary reel, i.e. the process speed. A braking mechanism is integrated in the supply compartment so that it maintains the stretch, i.e. longitudinal tension, in the material layer unwinding from the roll. As is common in machinery of this sort, the driving mechanism can be powered either by a motor or by an electric engine. A dilemma arises here because the driving mechanism of the primary reel can only develop the necessary tension in the material layer that is unwinding from the primary reel after the gluing on the fly of the beginning of the layer from the primary reel to the end of a foregoing roll from the secondary reel has been completed. Currently known devices of this sort have not addressed this problem so that a temporary lapse in longitudinal tension occurs in the instant after the two consecutive layers of material have been glued together on the fly.

What is needed in the art is a device which overcomes the problem described as a lapse in longitudinal tension and maintains the longitudinal tension during the gluing-on-the-fly operation.

SUMMARY OF THE INVENTION

According to the concept of this invention the driving mechanism causes the primary reel to rotate. After the tangential velocity at the circumference of the primary reel is very close to the processing speed of the material layer that unwinds from the secondary reel, the power output of the driving mechanism is raised by a small amount. This causes the tangential velocity at the circumference of the primary reel to be just a little higher than is necessary for the material layer to move on the fly, seemlessly into the process flow. Subsequently the primary reel is gradually slowed down by a braking mechanism, just enough such that the tangential velocity at the circumference is again very close to the process speed. Besides using an electric motor as a generator in order apply the braking force it is also possible to employ drum or disc brakes.

It is conceivable to employ electrical or hydraulic engines as driving mechanism for the primary reel. It is furthermore possible to utilize driving mechanisms that set the primary reel in rotational motion as well as braking its rotation. An electric motor can fulfill both of these duties because it can operate as a motor as well as a generator.

According to this invention the driving mechanism is not switched from engine to generator mode just a little before or exactly at the instant when the gluing-on-the-fly takes place. In contrast to what is common in today's state of technology, the switch from engine to generator mode occurs a considerable amount of time before the gluing-on the-fly takes place. Furthermore, the control unit initiates the braking action before the gluing-on-the-fly takes place and it regulates the braking force to the driving mechanism so that the longitudinal tension in the layer corresponds to the appropriate value at the very instant the gluing-on-the-fly takes place. The lapse in tension in the layer of material that usually occurs is completely eliminated as a result of the present invention.

The mechanism for the layer supply compartment of layered material that is developed on the basis of this invention which is primarily geared towards a process dealing with layers of paper includes a control unit which regulates the braking action by controlling the rotational speed as well as the tension in the layer of material.

A special embodiment of this invention regulates the braking action of the primary roll based on the criterion that at the time of connecting the unwinding layer and the primary roll the braking force applied to the driving mechanism maintains the tension in the layer of material. The present invention completely avoids any lapse in tension within the layer of material at the time the gluing-on-the-fly takes place.

It is especially advantageous to use an electric motor to power the unwinding and/or supply compartment, because it is quite easy to vary the size that is to be regulated by the control unit (see for example Dübbel, Handbook for Machine Design, page V39 to V46, Berlin, Heidelberg, 1995).

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
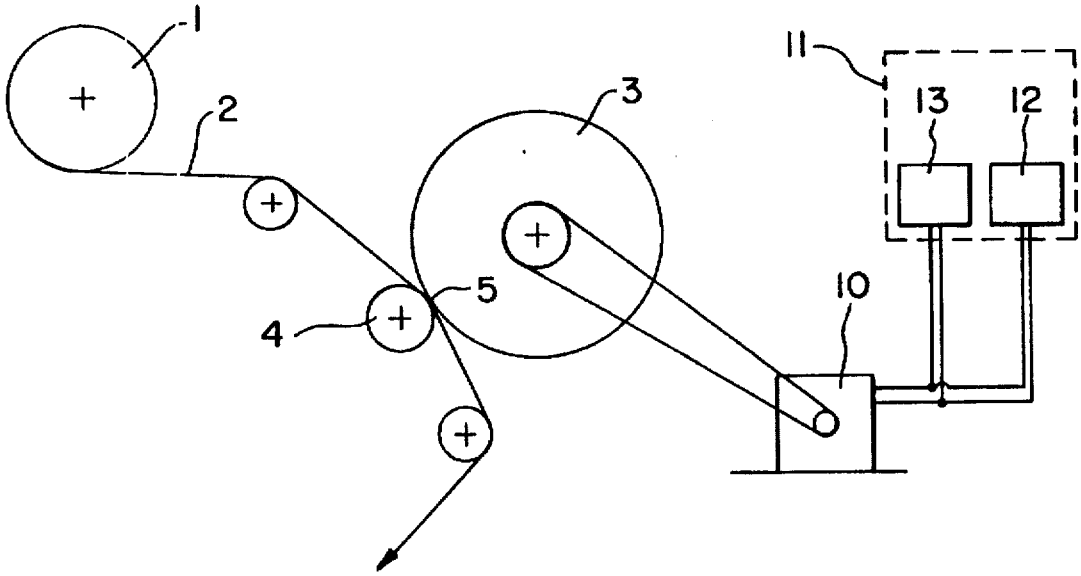
FIG. 1 is a roll compartment, according to the concept of this invention, powered by an electric motor.

Referring now to the drawings, FIG. 1 shows an unwinding and/or supply compartment according to the concept of this invention with a secondary reel 1 from which the material layer 2 unwinds and a primary reel 3 which holds the new material layer that is to be glued to the end of the preceding material layer as it runs out in the position that is indicated in the figure. The process of gluing the two material layers together takes place as the primary reel 3 with a roller 4 which facilitates the mechanical action to press the two layers together as they are being glued together approaches the compartment, thus forming a glue seam 5.

By cutting off the material layer with a knife edge, as it has been known for example from DE 38 15 277, one creates a trailing edge to the material layer 2 unwinding from secondary reel 1 which can now be attached to the glue seam 5 on the leading edge of the primary reel 3. A driving mechanism 10 such as an electric motor powers the primary reel and brings it up to a rotational speed, corresponding to a tangential velocity at the circumference which is at least as high as the unwinding speed of the secondary material layer 2 before the movement of the primary reel to the compartment is initiated and the operation of gluing together the two layers commences.

Driving mechanism 10 is connected with a control unit 11, which includes a rotational speed regulator 12 for the rotational speed of driving mechanism 10 as well as a tension regulator 13 for the tension in the material layer. The working principle behind the rotational speed regulator 12 and the tension regulator 13 is explained in the following paragraphs and illustrated in FIGS. 2 through 4.

Figure 2:
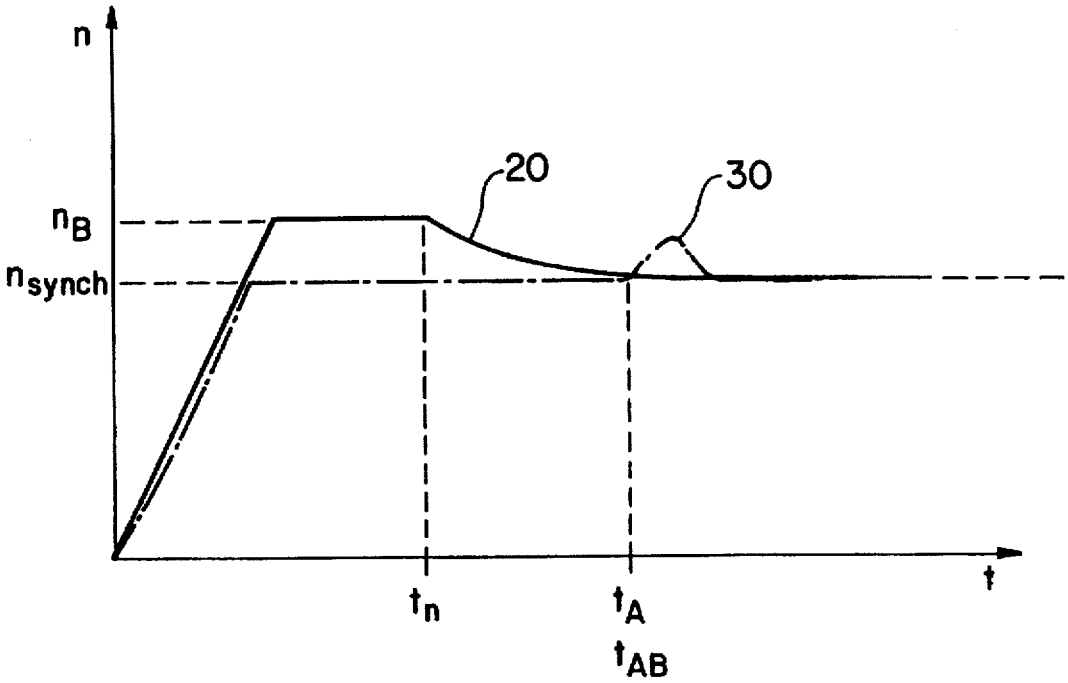
FIG. 2 is a histogram illustrating the progression of the number of revolutions per minute as a function of time of the driving motor according to the concept of this invention and according to the current state of technology.

FIG. 2 is a histogram which displays the progression of the rotational speed as a function of time of the driving mechanism 10 according to the concept of the invention on Curve 20 and according to the state of technology on Curve 30.

According to the state of technology, the primary reel is at the time $t_{AB}$, when the two layers are being glued to one another, brought up to a rotational speed, which corresponds to a tangential velocity at the circumference that is exactly as high as the unwinding speed of the secondary layer, as can be seen from FIG. 2. FIG. 2 depicts furthermore that the driving mechanism is at time $t_A$ switched from engine mode to generator mode. This leads to a temporary lapse in the tension within the material layer which can be concluded from Curve 30 which shows an increase in rotational speed of the primary tambour or the primary reel 3, respectively, just after the switch from engine mode to generator mode is completed.

Curve 20 shows in contrast to this the primary reel 3 moving at a constant rotational speed after the two layers were glued together which reflects that tension within the material layer remains constant. In order to achieve this it is according to this invention necessary that the primary drive mechanism drives the primary reel to a rotational speed in excess of the previous target value $n_{synch}$ up to a rotational speed $n_B$ before the secondary material layer 2 is cut off and glued to the primary material layer. The rotational speed regulator 12 ensures that the rotational speed is reduced in time to a value synchronous with the current process speed. The slowing down in rotational speed necessitates that the electric drive mechanism 10 be switched to generator mode at time $t_N$ before the cut off time $t_{AB}$ of the secondary material layer 2.

Figure 3:
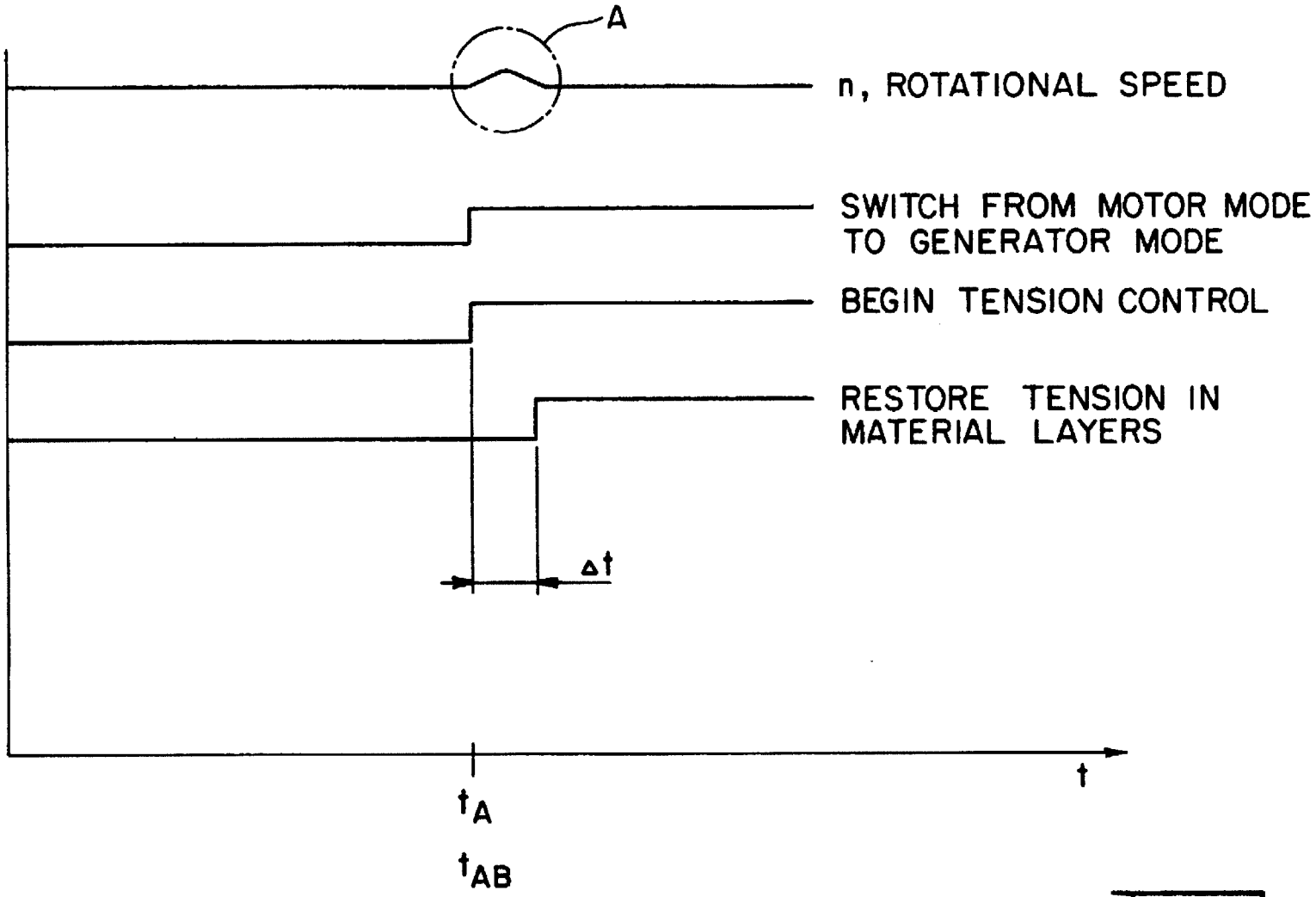
FIG. 3 is a histogram depicting the progression of several pertinent variables as functions of time during a period of operation, according to the current state of technology.

FIG. 3 shows the progression of several other variables as functions of time that are relevant to understanding this invention.

The diagram in FIG. 3 depicts several parameters pertaining to the operation of an apparatus of this sort built according to the current state of the art, as there are the progression of the rotational speed, n, as a function of time, the switch of the driving mechanism from motor mode to generator mode, the onset of the control over the tension in the material layer as well as the progression of the tension within the material layer as a function of time, t.

FIG. 3 describes in practical terms how at the time of cutting off the material layer or for that purpose the time of gluing the two consecutive layers to one another, respectively, according to the current state of the art, the drive of the primary reel was switched from motor mode to generator mode and it shows how the tension within the material layer is usually being controlled. This method obviously allows full control over the stretch within the layer only after a brief time, $\Delta t$, so that in other words, the tension within the layer suffers a temporarily lapse.

Figure 4:
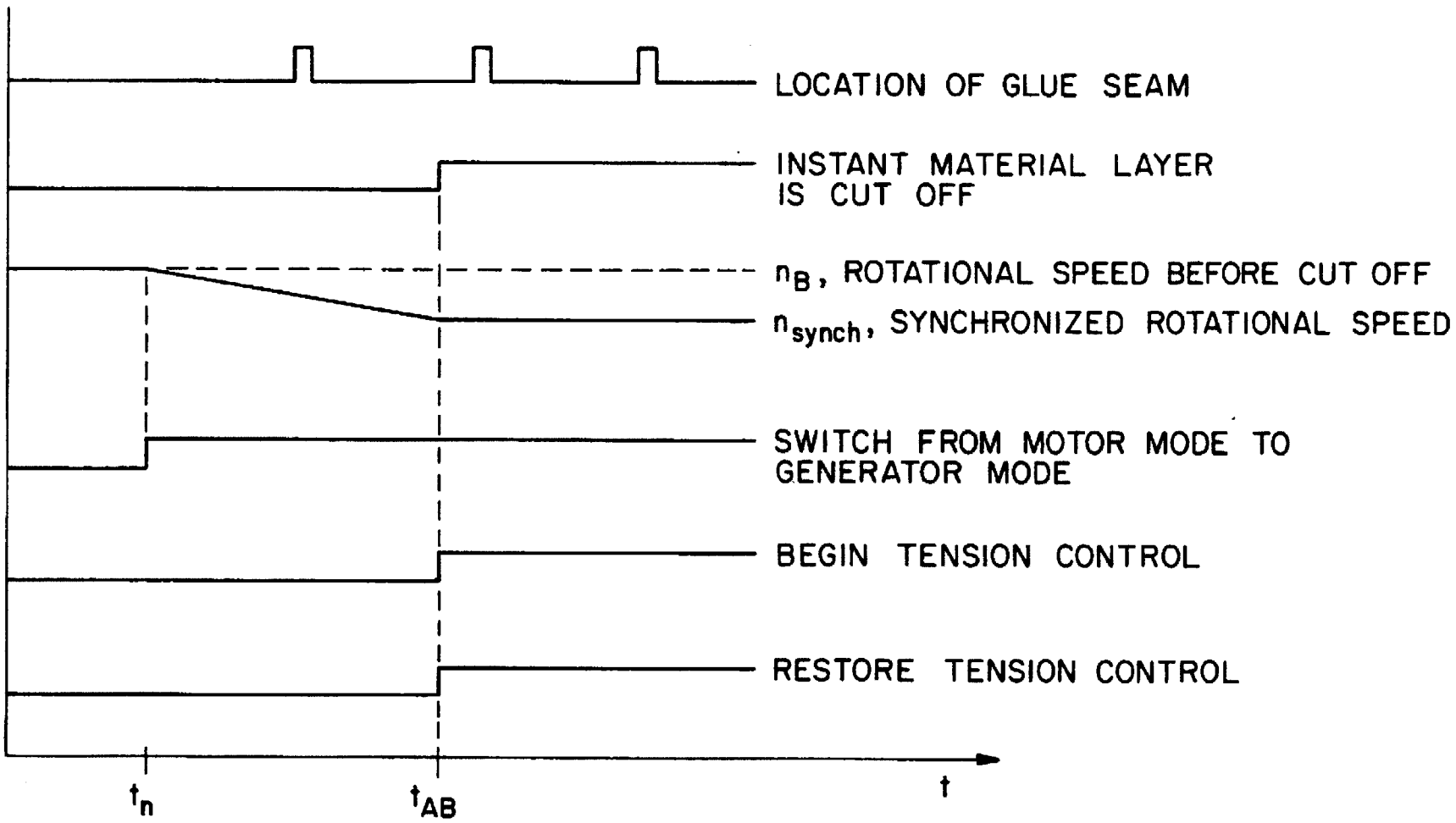
FIG. 4 is a histogram documenting the various events and actions to be taken during operation of the machinery according to the concept of this invention.

The timely variations of the parameters whose progress is being reflected in the histogram in FIG. 4 show how according to the invention the primary reel 3 is brought up to a rotational speed $n_B$ where the tangential speed along the circumference of the primary reel 3 is actually greater than the tangential speed along the circumference of the secondary reel, which is the same as the speed of the material layer unwinding from the secondary roll. At a point in time $t_N$ which is somewhat before the time $t_{AB}$ when the secondary material layer is being cut off the rotational speed of the primary reel is reduced down to a value of $n_{synch}$ so that the tangential velocity along the circumference of primary reel now corresponds to the unwinding speed of the material layer from the secondary reel 1.

To accomplish this it is necessary to switch the drive mechanism from motor mode to generator mode at time $t_N$, so that it begins to act as a brake. The braking action to slow the primary reel down to a value of $n_{synch}$ is applied such that the braking momentum at the instant when the secondary material layer is being cut off is sufficient to develop the necessary tension within the material layer. This means that for the ideal case that is illustrated here, the brake force at the time of material cut off is exactly that required to maintain the stretch within the material layer. By reversing the driving mechanism from motor mode to braking mode before the secondary layer is being cut off or before the two material layers are being glued together, respectively, there will not be any delay time and the mechanical noise will also not have any adverse effects on the gluing operation. The electric drive 10 can be brought up to the rotational speed $n_{synch}$ by means of a brake current.

The invention therefore provides an unwinding and/or supply compartment with drive control for the transition during the exchange on the fly reel holding the layer material, as well as an unwinding and/or supply compartment where the drive mechanism 10 to the primary reel 3 is at the time when the material layer is being cut off not only running in generator mode, but it has also built up a considerable portion of its brake momentum (brake current) "in time", which ideally is enough to maintain the tension in the material layer during the entire operation.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for at least one of unwinding and supplying material layers, comprising:

a primary reel with a primary material layer which unwinds therefrom, said primary reel being rotatable at a rotational speed with a tangential speed at a circumference thereof, said primary material layer having a leading edge;

a secondary reel with a secondary material layer which unwinds therefrom at a process speed, said secondary material layer having a trailing edge;

a mechanism for gluing on the fly the leading edge of said primary material layer with the trailing edge of said secondary material layer;

a rotatable driving mechanism coupled with said primary reel, said driving mechanism being operable as a drive and a brake; and a control unit connected with said driving mechanism, said control unit including a rotational speed regulator and a tension regulator, said rotational speed regulator controlling a rotational speed of said driving mechanism, said tension regulator maintaining a tension in the material layer after said primary material layer and said secondary material layer are glued together;

wherein said rotational speed regulator controls said driving mechanism as a drive such that said primary reel has a rotational speed $n_B$ resulting in a tangential speed of said primary reel which is faster than said process speed of said secondary material layer unwinding from said secondary reel;

wherein said rotational speed regulator controls said driving mechanism as a brake such that said rotational speed of said primary reel is decreased from said rotational speed $n_B$ down to a synchronized rotational speed $n_{synch}$, resulting in a tangential speed of said primary reel which is approximately the same as said process speed of said secondary material layer unwinding from said secondary reel; and wherein said rotational speed regulator further controls said driving mechanism such that at approximately the instant in time when said primary material layer is glued to said secondary material layer, a brake force in said driving mechanism corresponds to a tension force required in said primary and secondary material layers to maintain a stretch within said primary and secondary material layers.

2. The apparatus of claim 1, wherein said driving mechanism comprises an electric engine operable as a motor and a generator.

3. The apparatus of claim 1, wherein said driving mechanism includes one of cooled drum brakes and disc brakes for slowing said tangential speed of said primary reel.

4. The apparatus of claim 1, wherein said driving mechanism comprises one of an electric motor and a hydraulic motor.

* * * * *